US005426835A

United States Patent [19]

Neset et al.

[11] Patent Number: 5,426,835

[45] Date of Patent: Jun. 27, 1995

[54] TENTER FOR TREATMENT OF AN ENDLESS FABRIC

[75] Inventors: Karsten T. Neset, Kolborn; Helge Knutzen; Bart T. Boon, both of Oslo, all of Norway

[73] Assignee: ABB Alfsen & Gunderson AS, Oslo, Norway

[21] Appl. No.: 210,650

[22] Filed: Mar. 21, 1994

Related U.S. Application Data

[63] Continuation of Ser. No. 975,702, Nov. 13, 1992, abandoned.

[30] Foreign Application Priority Data

Nov. 15, 1991 [NO] Norway ..... 914489

[51] Int. Cl.[6] ..... D06C 3/00

[52] U.S. Cl. ..... 26/74; 26/93

[58] Field of Search ..... 26/72, 73, 74, 89, 93, 26/94, 96, 52, 71

[56] References Cited

U.S. PATENT DOCUMENTS

| | | | |
|---|---|---|---|
| 903,144 | 11/1908 | Whitley | 26/93 |
| 2,283,699 | 5/1942 | Richardson | 26/74 |
| 2,350,961 | 6/1944 | Haskins | 26/94 |
| 3,123,854 | 3/1964 | Aykanian | 26/73 |
| 3,150,433 | 9/1964 | Kampf | 26/73 |
| 3,175,245 | 3/1965 | Kreeft et al. | 26/94 |
| 3,382,554 | 5/1968 | Harmon et al. | 26/52 |
| 4,200,963 | 5/1980 | Kamfe et al. | 26/73 |
| 5,263,235 | 11/1993 | Duncan et al. | 26/89 |

FOREIGN PATENT DOCUMENTS

| | | | |
|---|---|---|---|
| 166005 | 7/1921 | United Kingdom | 26/89 |
| 229758 | 3/1925 | United Kingdom | 26/89 |

*Primary Examiner*—Clifford D. Crowder
*Assistant Examiner*—Amy B. Vanatta
*Attorney, Agent, or Firm*—Dressler, Goldsmith, Shore & Milnamow, Ltd.

[57] ABSTRACT

Tenter for an endless fabric, especially for use by heat treatment as a part process in connection with manufacturing of fabric for a paper machine comprising several carriages (1) for guiding the rims of the fabric material by means of a carrier (2) for each carriage (1) which is connected with a drive chain. Each carriage (1) comprises at least one spring (4) arranged between the carrier (2) and an abutment in the carriage (1) such that the velocity of each carriage (1) substantially corresponds with the speed of the fabric rim. It also includes a mechanism for registering and monitoring the tension force in the material based on which the velocity of the drive chain and the carrier (2) is adjusted to maintain a desired velocity for the fabric through the heat treatment zone.

7 Claims, 1 Drawing Sheet

TENTER FOR TREATMENT OF AN ENDLESS FABRIC

This application is a continuation of application Ser. No. 07/975,702, filed Nov. 13, 1992, now abandoned.

The present invention is related to tenters for an endless fabric according to the preamble of the claims.

During heat treatment of such a fabric it is of greatest importance that the fabric be maintained uniformly across the entire fabric, e.g. that the condition of the product near the edges is as much the same as possible as the rest of the fabric. The fabric as such normally is present as an endless web, suspended between two or more principally parallel cylinders where the products are stretched in the longitudinal direction of the fabric. At least one of the cylinders is provided with driving means rotating the cylinder and thereby transporting the fabric around and between the cylinders.

Tensioning frames or tenters maintain the products in tension in the transversal direction during its movement in the longitudinal direction thereby to control the shrinkage in the transversal direction and to avoid creation of folds in the longitudinal direction due to the shrinkage in the transversal direction. Often carriages provided with needles or clamps are used for this purpose, to which the rims of the product are secured and which follow the movement of the product in a track thereby to maintain a desired tension in the transversal direction through the heating zone arranged across the direction of movement for the product. When the products are secured to the carriage it is necessary that this is done without forces going into the product and that forces act only after the product has been secured to the carriage.

As the product, however, during its movement in the longitudinal direction, is treated in such a way that the product is stretched or shrinked, this means that the distance between the rims of the product may be changed along the direction of movement of the product, however also that speed in the longitudinal direction is amended through the heating zone. Several known embodiments of tenters have not been able to take care of this as the carriages are moved in a track with a chain based driving device, by which all carriages necessarily have the same speed and thereby travel the same distance. This leads to the rims on some places are being moved with another speed than the middle portion which creates an angular deformation of the product near the rims. Other embodiments of tenters use carriages which are not connected with a chain. Here the carriages are pulled by the product, thereby creating forces between the carriages and the track. Such forces may lead to deformations in the product near the rims.

With the tenter according to the present invention the above mentioned disadvantageous are avoided. The speed of the rims are designed to be substantially the same as the speed in the middle of the product. This is achieved with the tenter according to the present invention as defined by the features stated in the claims.

Figure 4:
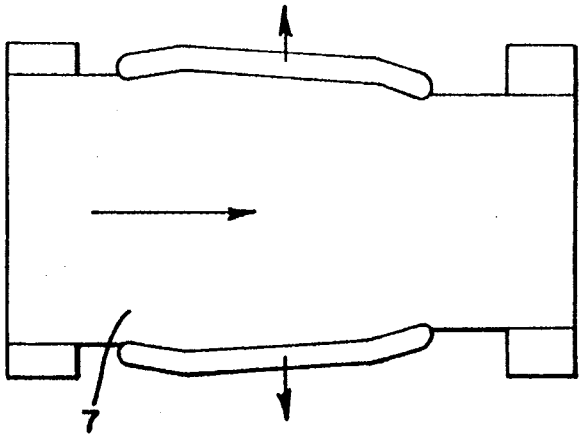
Figure 3:
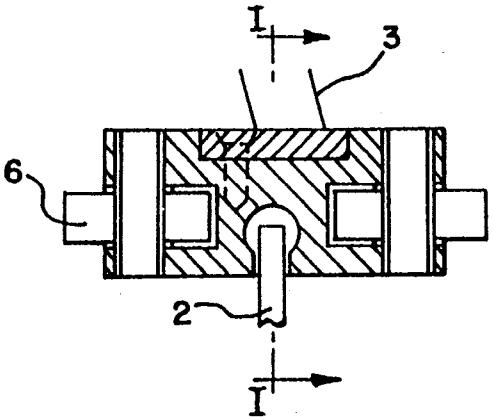
Figure 1:
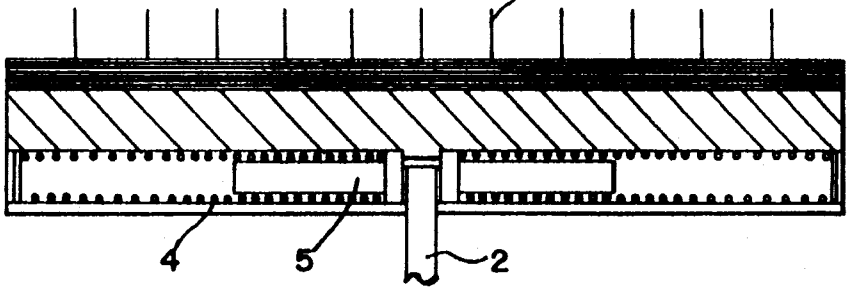
Figure 2:
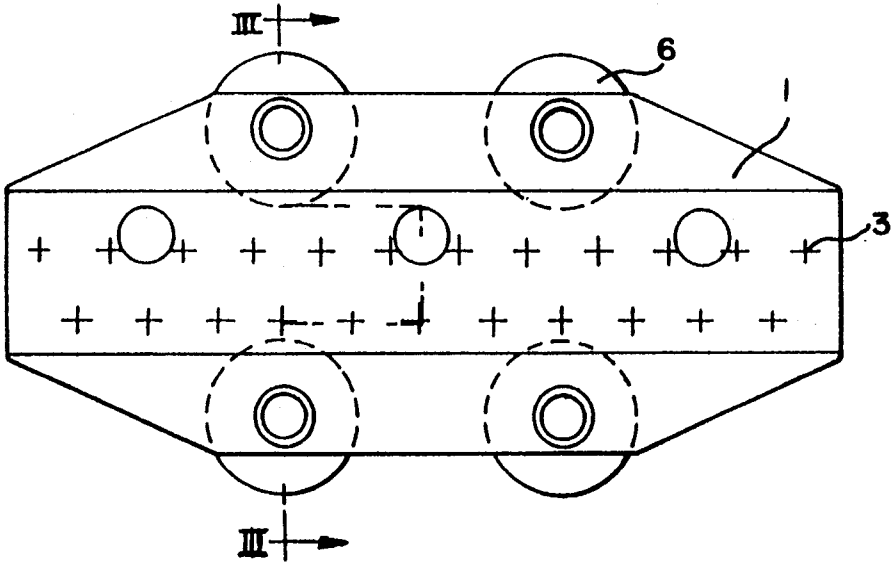

The drawing discloses in FIG. 1 a longitudinal section of a carriage forming part of a tenter according to the present invention, provided with needles to hold the product, and is taken in cross section along I—I in FIG. 3. FIG. 2 discloses a plan view of the carriage, FIG. 3 discloses a cross section along III—III in FIG. 2 and FIG. 4 discloses an overview of the arrangement of the tenters.

The carriage 1 discloses four wheels or ball bearings 6, two on each side, adapted for abutment against a guiding track (not shown) extending in the longitudinal direction of the tenter. On top of the carriage 1 are arranged inclined needles 3 which as known preferably are secured to an insert. In the track of the tenter a chain (not shown) is running with carriers 2 catching the single carriages 1 and moving those along the track of the tenter.

As disclosed especially in FIG. 1 the carriage 1 is not arranged above the carrier 2 with a fixed connection between the carriage and the carrier, but the carrier 2 is arranged between opposed pins 5 both of which are biased with springs 4 which bias the pins against an abutment. The distance between the two pins 5 when situated against its respective abutment, corresponds substantially to the diameter of the carriers 2. The characteristic of the springs 4 and further properties are very exactly chosen in relation to the function to be provided. The characteristics of the springs therefore may be different, possibly one of the springs may completely be omitted.

The purpose of the springs 4 is to allow a displacement of the carrier 2 in relation to the abutment in the carriage 1 on places along the path of the product where the speed of the product and the speed of the carrier are different.

This displacement should be possible substantially without any stress on the product in the longitudinal direction. Seen on this background it also is very clear that the properties of the spring 4 are very important as the spring pressure should ensure that the rims of the product are moved at the same speed as the rest of the product in conjunction with the carrier 2 that is moved with a constant speed in the longitudinal direction. The speed of the product, however, will not be constant, but differ substantially in different portions of the path.

The spring forces hereby should compensate the resulting force from the friction force between the ball bearings 6 and the track on one hand and on the other hand the transversal component of the tension force in the displacement direction of the product. This is achieved by calculating the forces from measurements of the transversal force as well as possible inclinement of the track in relation to the displacement direction of the product.

The chain drive is controlled such that the tension in the chain which substantially corresponds with the total spring forces, equals the calculated resultant. The tension in the chain may be measured such as by a loading cell in the suspension device for the chain drive motor. With the tenters according to the present invention transversal forces are laid on the rims of the fabric to maintain the tension uniformly in the fabric, the transversal forces thereby moving simultaneously with the fabric movement acceleration and retardation, due to the spring connection between the needles in the rim, for which the speed varies, and the chain having a constant speed.

We claim:

1. A tenter for moving fabric material having rim portions through a heat treatment zone comprising a plurality of carriage means having the rims of fabric secured thereto for guiding the rims of the fabric material through the heat treatment zone including a carrier for each carriage means, which carriers are connected to a drive chain driven by a motor, characterized in that each carriage means comprises at least one spring biasing means disposed between a carriage and its respective carrier to form a resilient connection between the carrier and said carriage, whereby the carriage means can be moved relative to its respective carrier so that the speed of the carriage substantially corresponds with the speed of the fabric during movement through the heat treatment zone.

2. A tenter according to claim 1 characterized in that each carriage means comprises oppositely disposed springs acting against the carrier to permit increasing or decreasing speed of the carriage means relative to the carriers.

3. A tenter according to claim 1 characterized in that the carriages are mounted in a track and are subject to friction forces, means are provided for monitoring the force imposed on the drive chain by the fabric material comprising a load cell that is positioned to be responsive to said fabric-imposed forces on said chain to regulate said drive motor to overcome the friction forces and act to insure that the weft threads of the fabric remain substantially linear.

4. A tenter according to claim 2 characterized in that the carriages are mounted in a track and are subject to friction forces, means are provided for monitoring the force imposed on the drive chain by the fabric material comprising a load cell that is positioned to be responsive to said fabric-imposed forces on said chain to regulate said drive motor to overcome the friction forces and act to insure that the weft threads of the fabric remain substantially linear.

5. A tenter as set forth in claim 1 in which the connection between the carrier and carriage consists of at least one pin means connected to said chain and extends into a chamber defined by said carriage, said spring means are located in said chamber and consist of springs located on both sides of said pin means, and normally act to bias the pin to a neutral position relative to said carriage.

6. A tenter as set forth in claim 1 in which each carriage includes a plurality of rollers that are positioned in a guide track and the connection between each carriage and the chain consists of a plurality of pin means, each of which is subjected to oppositely acting spring means.

7. A tenter as set forth in claim 1 in which each carriage includes a plurality of pins to which the rims of the fabric are connected.

* * * * *